United States Patent [19]

Bulso, Jr. et al.

[11] 4,416,140

[45] Nov. 22, 1983

[54] CAN REMOVAL METHOD FOR USE WITH A DOUBLE ACTION CUPPER

[75] Inventors: Joseph D. Bulso, Jr.; William R. Lewers, both of Canton, Ohio

[73] Assignee: Redicon Corporation, Canton, Ohio

[21] Appl. No.: 338,213

[22] Filed: Jan. 11, 1982

Related U.S. Application Data

[62] Division of Ser. No. 171,905, Jul. 24, 1980, Pat. No. 4,343,173.

[51] Int. Cl.[3] ..... B21D 45/00

[52] U.S. Cl. ..... 72/345; 72/347; 72/427

[58] Field of Search ..... 72/344, 345, 347, 349, 72/427

[56] References Cited

U.S. PATENT DOCUMENTS

| | | | |
|---|---|---|---|
| 3,402,591 | 9/1968 | Maeder | 72/345 |
| 3,771,344 | 11/1973 | Wright | 72/345 |
| 3,902,347 | 9/1975 | Ridgway et al. | 72/336 |
| 4,248,076 | 2/1981 | Bulso, Jr. et al. | 72/349 |
| 4,280,353 | 7/1981 | Murphy | 72/345 |

*Primary Examiner*—Leon Gilden
*Attorney, Agent, or Firm*—Reese Taylor

[57] ABSTRACT

A double action draw press having inner and outer rams reciprocal with respect to a fixed base for forming two piece containers such as beverage or food containers from metal sheet stock. The apparatus includes a pressure system carried by the outer ram and adapted to hold the material during the drawing operation. The apparatus also includes a drawing horn secured to the inner ram and movable independently of the pressure sleeve system. The drawing horn has an inwardly directed recess in its outboard end which communicates with an internal air passage leading to a source of air pressure. This structure permits use of an improved method of removing the formed can from the press by permitting air pressure to be applied to the interior wall surfaces of the drawn container as the press opens to move it out of the press for further processing. The horn is capable of being rotated about its longitudinal axis and fixed in any desired position so that this air passage is capable of being precisely directed whereby the air applied to the container will direct the container in a predetermined direction.

2 Claims, 4 Drawing Figures

CAN REMOVAL METHOD FOR USE WITH A DOUBLE ACTION CUPPER

RELATED APPLICATION

This application is a division of applicants' earlier filed application, Ser. No. 171,905, filed July 24, 1980 now U.S. Pat. No. 4,343,173.

BACKGROUND OF THE INVENTION

This invention, in general, relates to a cupper for forming containers from sheet stock of either steel or aluminum and relates, in particular, to a method of operating a double action draw apparatus wherein a container is first formed and wherein the formed container is then moved out of the operative area of the press by unique air pressure means carred by the drawing horn.

DESCRIPTION OF THE PRIOR ART

Ridgeway U.S. Pat. No. 3,902,347 is of general interest in showing an overall double action press arrangement suitable for receipt of the tooling necessary to carry out the draw operation. The structure of that patent is illustrative of apparatus that is capable of blanking and drawing the container in one stroke.

This particular application is directed primarily to the method by which the drawn container is removed from the press for further processing after it has been formed by suitable draw and redraw methods.

In this regard, applicant is aware of prior art wherein a stream of air is directed into the operative area of the press between the upper and lower platens and against the exterior of the container in order to move it out of that area of the press for further processing. Applicant is also aware of mechanical means for reaching into this area and extracting the containers. However, both of these methods have disadvantages.

Directing a stream of air against the exterior of the container results in uncontrolled movement of the container. In other words, the containers are, of course, of rather thin gauge metal and light weight and are naturally empty at this stage of the overall manufacturing process and when air is blown against the exterior of such a container, it will tumble and will move out of the press area in an uncontrolled and random fashion. This is disadvantageous for a number of reasons.

First, most of the containers have a chemical coating on them since they are used for food and beverages. When the cans tumble in the prior art operation, there is danger of damage to this coating and that can subsequently lead to difficulties in connection with the integrity of the product which is ultimately packed into the cans.

Second, this tumbling can cause the cans to bang into each other and cause dents or other imperfections in the containers.

Additionally, while the drawings of this application illustrate only one draw horn, it ought to be understood that a press would normally have a plurality of these draw horns. Therefore, there would be a number of containers coming out of the press after each closing and opening thereof and it is desirable to direct the containers in a predetermined path so that they do not come into contact with each other. This cannot be accomplished by the random methods of the prior art.

Finally, mechanical means which can be devised to reach into the open area of the press and more or less extract the containers are obviously much too expensive to make the production process economical.

Applicant is also aware of certain prior art patents wherein pressurized fluid is employed to strip formed containers from the punch head or draw horn. Examples of this art can be seen in Maeder U.S. Pat. No. 3,402,591; Wright U.S. Pat. No. 3,771,344; and Murphy U.S. Pat. No. 4,280,353. This art, however, merely discloses ways of removing the formed container from the forming tool and not from the press itself.

SUMMARY OF THE INVENTION

It has been found that providing a double action draw press or cupper of the type referred to above with regard to the description of the prior art with an improved blow off means incorporated into the draw horn, that the disadvantages of the prior art set forth above can be overcome.

Thus, it has been discovered that the draw horn itself can be provided with an inwardly directed, recessed area in its outboard end and further provided with an internal passage opening into this area and connected to a source of a pneumatic pressure.

It has then been found that by utilizing such a horn that it is possible to apply air under pressure to the interior surfaces of the container as contrasted to the exterior, as in the prior art, and practical application of this concept has proved that the containers will not tumble, but will slide smoothly out of the operative area of the press.

Furthermore, it has been discovered that since the horn is capable of being fixed in a predetermined position relative of the ram which carries it, it is possible to orient the air passageway in the horn so that not only can the containers be moved smoothly out of the operative area of the press without tumbling of banging into each other, but they can be directed in a predetermined direction. This is particularly advantageous where a plurality of draw horns are contained in a single press so that the containers being formed by each horn can be guided in different directions so as to exit the press in an orderly fashion.

Accordingly, production of an improved method of the character above described becomes the principle object of this invention, with other objects thereof becoming more apparent upon a reading of the following brief specification considered and interpreted in view of the accompanying drawings.

OF THE DRAWINGS

BRIEF DESCRIPTION OF THE PREFERRED EMBODIMENT

Figure 1:
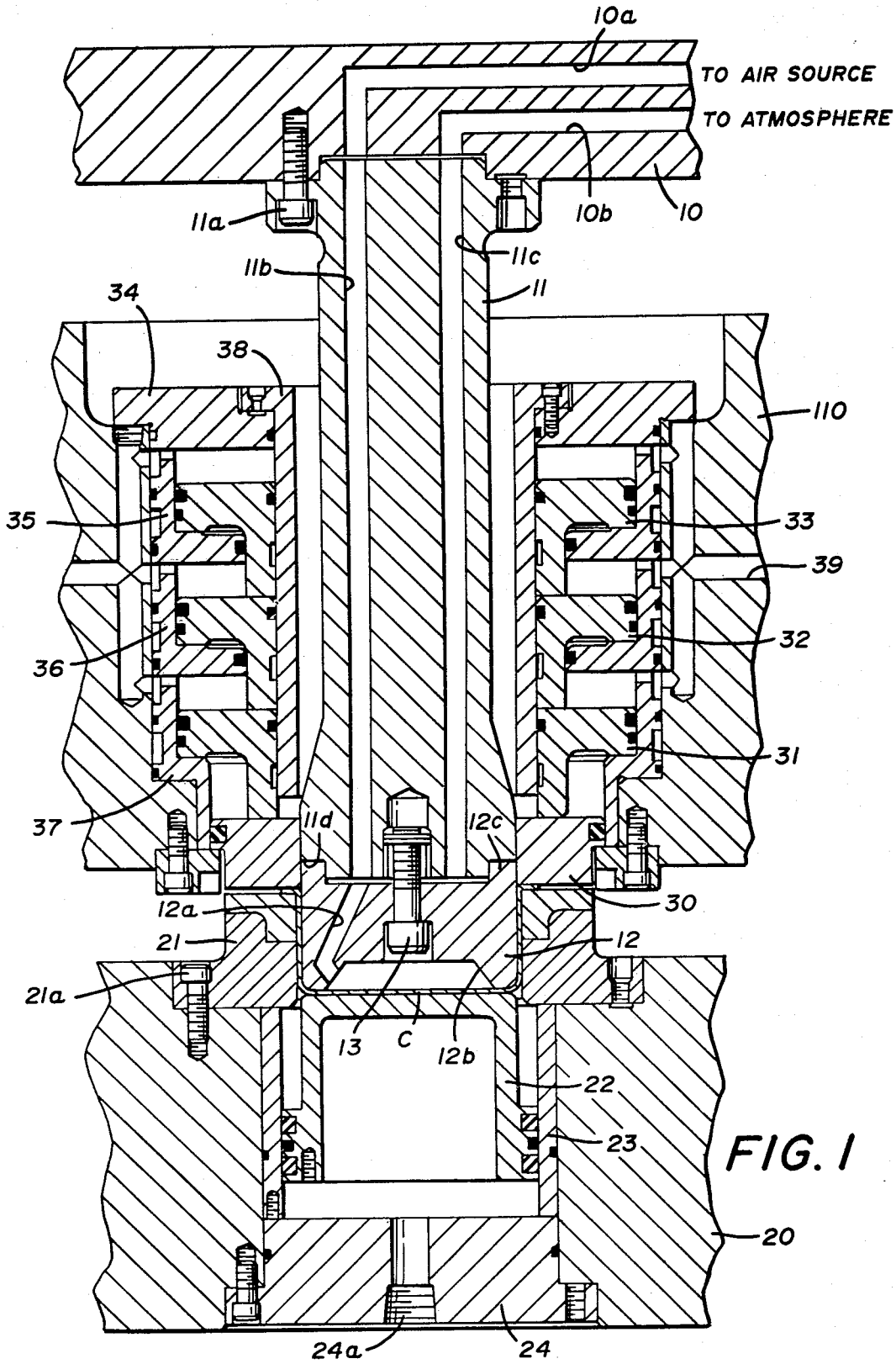
FIG. 1 is a sectional elevational view showing a drawing apparatus with the improved can removal means.

Referring to FIG. 1 of the drawings for a general description of the improved apparatus for carrying out the method, it will be noted that an inner ram 10 and an outer ram 110 are illustrated. A bottom bolster or base 20 is also provided and the rams are reciprocal with respect to the bolster 20. The press mechanism is not further illustrated in detail since such apparatus is known to those skilled in the container making art. It should, however, be noted that the invention has particular relevancy to double acting presses.

Secured to the inner ram 10 is a draw horn riser 11 which is attached to the ram by one or more screws such as 11*a*. The ram 10 has through passages 10*a* and 10*b* bored therein and the passage 10*b* leading to the atmosphere for venting purposes.

The riser 11 also has through longitudinally extending passages 11*b* and 11*c* with the passage 11*b* communicating with passage 10*a* and the passage 11*c* communicating with the passage 10*b*.

At the bottom or outboard end of the riser 11, a draw horn 12 is provided and is attached to the riser by means of the screw 13. This screw 13 permits some relative adjustment between the horn 12 and the riser 11. However, while these two components may be spaced from each other, they are essentially interconnected in an air tight configuration due to the engagement of shoulders 12*c* with recesses 11*d*.

It will also be noted that the draw horn 12 has an air passage 12*a* extending from its top to its bottom and that this passage is in fluid communication with the passages 11*b* and 10*a* and thus, with the source of air under pressure (not shown). Additionally, at the extreme outboard or bottom end of the horn 12, a recessed area 12*b* is formed and the passage 12*a* opens into that area and opens into it at an angle relative to a horizontal plane defined by the die line, for purposes which will be described below.

The outer ram 110 carries a pressure system consisting of a series of first, second, and third pistons 31, 32, and 33, stacked one upon the other and open to a source of high pressure air. These pistons are carried in first and second cylinders 35 and 36 and lower cylinder 37 and the entire chamber is closed off by the cap 34.

A sleeve 38 is also carried internally of the ram 110 so as to form part of the chamber within which the pistons 31, 32, and 33 operate.

Also, a pressure pad 30 is carried by the outer ram 110 and is acted on by the piston 31, which is, in turn, acted on by piston 32 under pneumatic pressure. This operation is generally fully disclosed in applicants' copending application Ser. No. 119,021, filed Feb. 6, 1980, and entitled Double Action Redraw Press, and will not be described in great detail here except to not that the pad 30 does perform the "hold down" function during the draw operation.

The bottom bolster 20 carries a blank and draw die 21 which is secured thereto by one or more screws 21*a*. The bolster 20 has a hollow interior and carries a lift out pad and piston 22, which is pneumatically or hydraulically actuated. That lift out pad 22 travels in the sleeve 23 and a cap or bottom plate 24 closes off the bottom of the bolster 20. The course of operating fluid for piston 22 is injected through bore 24*a*. This arrangement is not illustrated or described in detail since many lift out means will be known to those skilled in the art.

In operation, reference is first called to FIG. 1 of the drawings. In that figure, the container C has been drawn by horn 12 and the inner ram 10 is at the bottom dead-center position.

Figure 2:
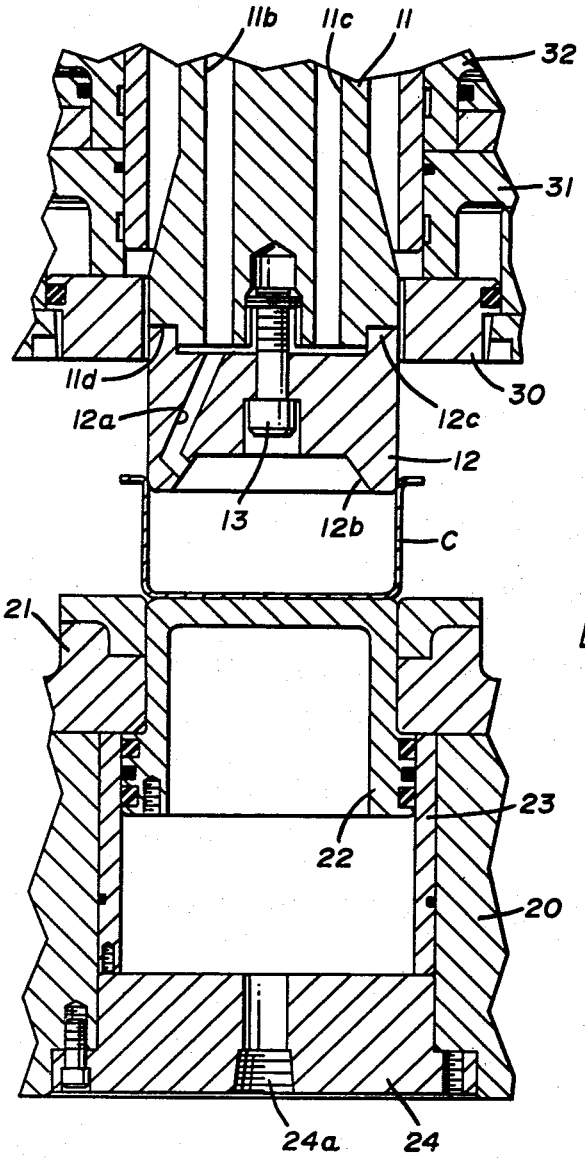
FIG. 2 is a partial sectional view of the draw apparatus showing the drawn horn and the hold down system partially open.
Figure 3:
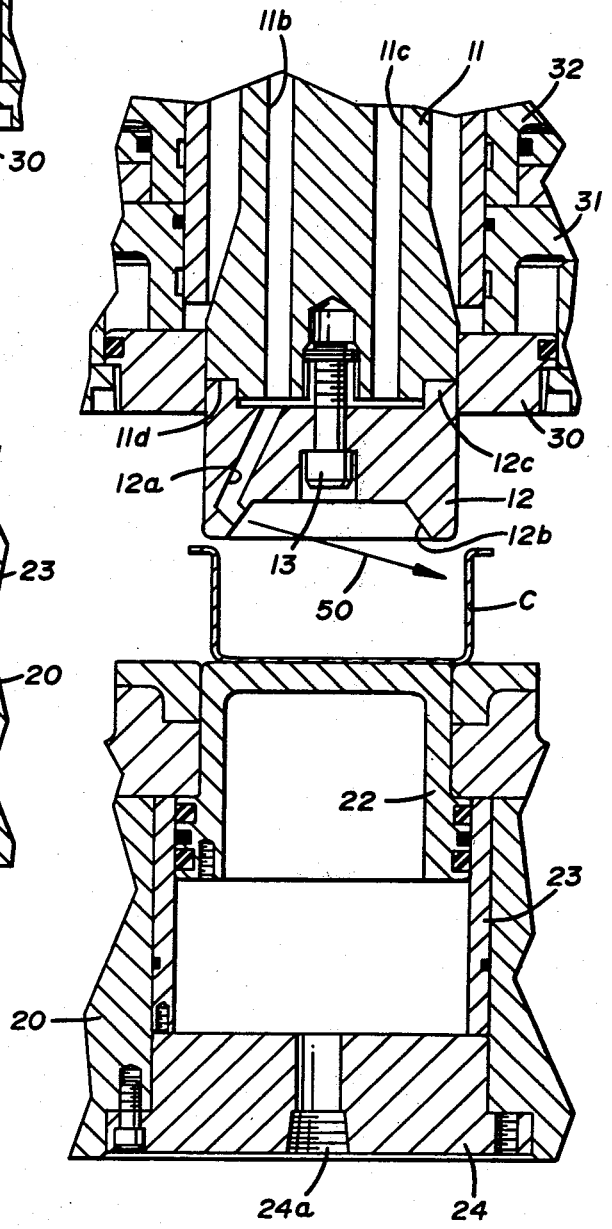
FIG. 3 is a view similar to FIG. 2 showing the application of the internally directed air from the horn.
Figure 4:
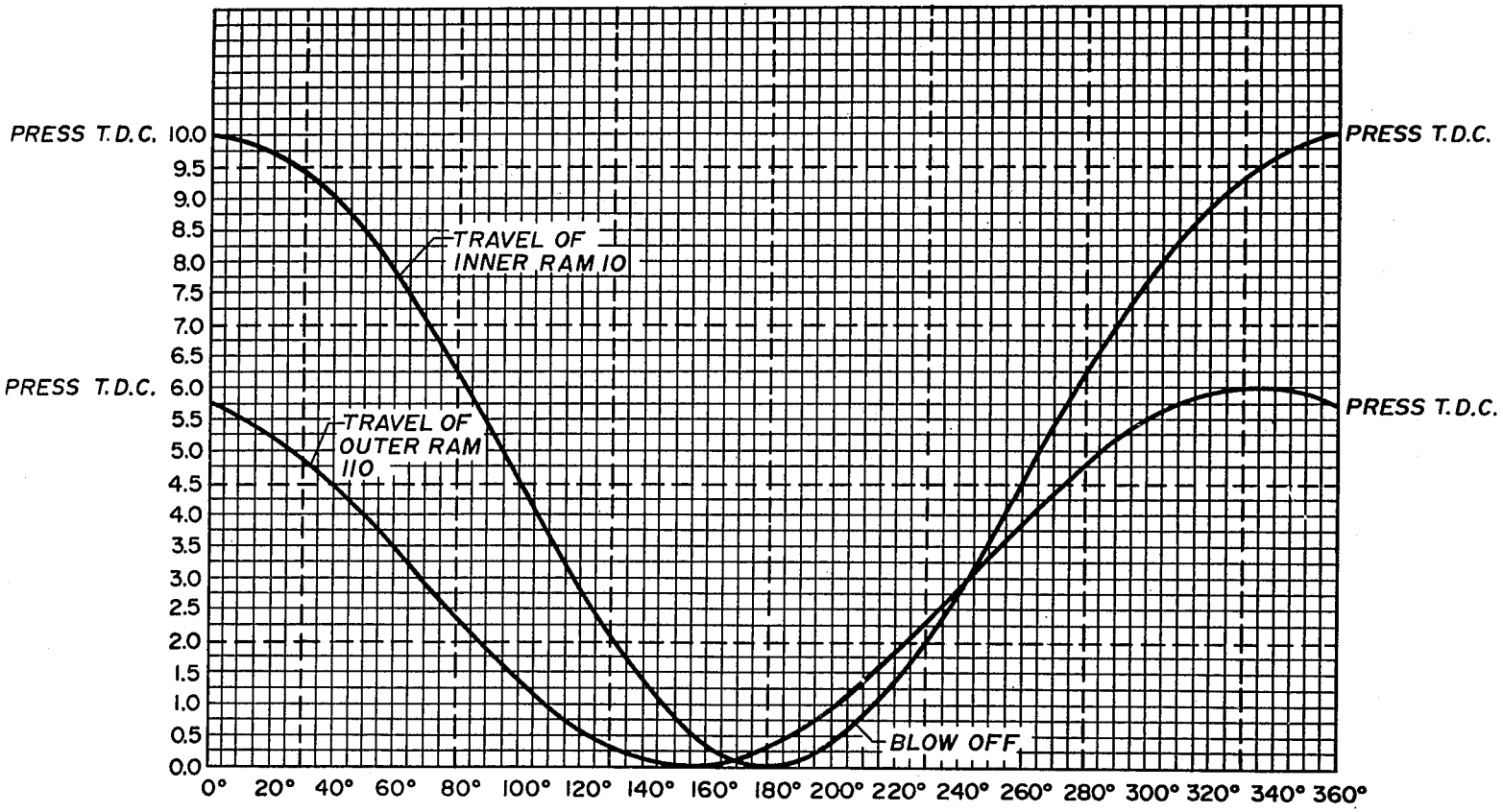
FIG. 4 is a graph of the movement of the inner and outer rams and the operational sequence thereof.

At this point, referring to FIGS. 2 and 4, it will be seen that the lift off operation has commenced with both the inner and outer rams moving in an upward direction and with the lift out pad or piston 22 also forcing the container C in that direction. In FIG. 2, the bottom of the container C has just reached the die line and the horn 12 is just about to clear the top of the container. Keeping in mind that this is one continuous operation, air pressure is then caused to pass through the passages 10*a*, 11*b*, and 12*a* and out through the recessed area 12*b* in the horn 12 in the direction of the arrow 50. This will direct that air pressure against the interior of the container C and will cause it to move in a smooth, controlled fashion out of and away from the press and onto a conveyor or other surface for further processing.

On the timing diagram of FIG. 4, this will occur when the ram has been lifted a distance equal to at least two container heights, i.e., one height to get the container up the die line and one to enable the horn to just clear the top of the container.

As noted above, it should also be kept in mind that the riser 11 can be rotated about its axis relative to horn 12 and secured in different positions so that in a multiple horn operation, the air flow 50 can be directed in different directions. In this fashion, the container C that is drawn by each horn can be directed in a suitable path to avoid unnecessary contact and inadvertent damage thereto.

It also should be noted that essentially the burst of air used to move the container C is contained within the container and is directed against the interior surfaces thereof and that less force is required than with the known external systems.

While a full and complete description of the invention has been set forth in accordance with the Patent Satutes, it should be understood that modifications may be resorted to without departing from the spirit hereof or the scope of the appended claims.

What is claimed is:

1. A method of forming a container from sheet stock in a double acting press comprising the steps of:

(A) closing the press and blanking the stock;

(B) forming the container with a draw horn and forming die;

(C) opening the press and ejecting the formed container from the forming die while simultaneously withdrawing the draw horn;

(D) initially directing pressurized air only against at least part of an interior wall surface of the formed container to expel it from the press as the container reaches the die line and the draw horn clears the container.

2. The method of claim 1 wherein (A) a plurality of containers are blanked and formed on each cycle of the press; and (B) pressurized air is applied to the containers so as to expel them from the press in different directions.

* * * * *